US011192044B2

(12) United States Patent
Smith

(10) Patent No.: US 11,192,044 B2
(45) Date of Patent: Dec. 7, 2021

(54) MOBILE KIT THAT REVOLVES FROM A CEILING FAN

(71) Applicant: Margaret Marilyn Smith, Waterford, VA (US)

(72) Inventor: Margaret Marilyn Smith, Waterford, VA (US)

( * ) Notice: Subject to any disclaimer, the term of this patent is extended or adjusted under 35 U.S.C. 154(b) by 0 days.

(21) Appl. No.: 14/257,970

(22) Filed: Apr. 21, 2014

(65) Prior Publication Data

US 2014/0315467 A1 Oct. 23, 2014

Related U.S. Application Data

(60) Provisional application No. 61/814,762, filed on Apr. 22, 2013.

(51) Int. Cl.
*A63H 33/00* (2006.01)
*G09F 19/02* (2006.01)

(52) U.S. Cl.
CPC ..... *A63H 33/006* (2013.01); *G09F 19/02* (2013.01)

(58) Field of Classification Search
CPC ..... A63H 33/006; G09F 19/02
USPC ..... 446/227, 228, 236, 238
See application file for complete search history.

(56) References Cited

U.S. PATENT DOCUMENTS 106,262 A * 8/1870 Fine ..... A63B 19/00 446/236
442,629 A * 12/1890 Lipscomb ..... A63H 33/006 248/231.31
810,900 A * 1/1906 Bartlett ..... A63H 33/006 248/629
1,436,367 A * 11/1922 Sullivan ..... A63H 33/006 446/227
1,634,162 A * 6/1927 Tesk ..... A61J 9/06 248/102
2,405,313 A * 8/1946 Martin ..... A63H 27/004 124/32
D171,594 S * 3/1954 Hagey ..... 446/227
2,769,276 A * 11/1956 Steiner ..... A63H 33/006 428/7
2,930,159 A * 3/1960 Culhane ..... A01K 91/053 43/42.74
2,994,156 A * 8/1961 Steiner ..... A63H 33/006 446/227
3,136,544 A * 6/1964 Strayer ..... A63H 27/04 446/236
3,165,219 A * 1/1965 Johnson ..... A61J 9/00 215/11.1
3,290,817 A * 12/1966 Kravath ..... A63H 33/006 40/412

(Continued)

*Primary Examiner* — Joseph B Baldori

(57) ABSTRACT

A mobile kit that revolves from the airflow of a ceiling fan. The mobile kit comprises a display structure that is attached to a balancing platform by one or more bridles, which permits balancing and rebalancing of the mobile when ornaments are added, removed or relocated. The balancing platform is attached to the lower end of a fan attachment device, which is a swivel chain with attachment means, or a similar device with one or more swivel attachment means that permits continuous rotation of the display structure in the airflow. A wide variety of designs for ornaments, display structures, and balancing platforms permit limitless design themes for home, office, or any place where ceiling fans are used.

46 Claims, 13 Drawing Sheets

(56) References Cited

U.S. PATENT DOCUMENTS 3,564,759 A * 2/1971 Buttermore ..... A63H 33/006 248/104
3,699,704 A * 10/1972 Hakim ..... A63H 3/28 428/7
3,762,084 A * 10/1973 Jones ..... A63H 33/40 40/613
3,927,482 A * 12/1975 Marcus ..... A61M 21/00 40/455
3,978,610 A * 9/1976 Stubbmann ..... A63H 33/40 248/102
4,147,344 A * 4/1979 Lee ..... A63B 21/0552 273/331
4,207,696 A * 6/1980 Hyman ..... G09F 19/02 40/457
D262,000 S * 11/1981 Gall ..... D11/141
4,425,388 A * 1/1984 Oppenheimer, Jr. .. A63H 33/40 428/16
4,430,818 A * 2/1984 Marcus ..... A47G 35/00 40/429
4,438,727 A * 3/1984 Thompson ..... A01K 15/025 119/708
D278,446 S * 4/1985 Kujawski ..... D21/467
4,567,682 A * 2/1986 Hurxthal ..... G09F 19/02 40/617
4,627,588 A * 12/1986 Block ..... A63H 33/006 248/105
4,756,109 A * 7/1988 Marcus ..... A63H 33/006 40/455
4,880,197 A * 11/1989 Wsyzynski ..... A63H 33/40 248/324
D306,323 S * 2/1990 Wise ..... D21/467
4,901,458 A * 2/1990 Belokin ..... G09F 19/02 40/414
4,904,220 A * 2/1990 Williams ..... A63H 33/006 446/227
4,930,448 A * 6/1990 Robinson ..... A01K 15/025 119/708
4,949,486 A * 8/1990 Belokin ..... A63H 13/20 40/414
4,984,380 A * 1/1991 Anderson ..... G09F 19/02 40/455
D315,371 S * 3/1991 Van Risseghem ..... D11/141
D327,714 S * 7/1992 Meigs ..... D11/141
5,146,702 A * 9/1992 Belokin, Jr. ..... G09F 19/08 40/414
D334,219 S * 3/1993 Matsumoto ..... D11/141
5,246,374 A * 9/1993 Boodram ..... A47G 1/065 40/730
5,352,145 A * 10/1994 Raiffe ..... A63H 33/006 24/457
D364,652 S * 11/1995 Santana ..... D11/141
D371,170 S * 6/1996 Melandow ..... D21/467
5,606,816 A * 3/1997 Schwartz ..... G09F 7/22 40/605
5,620,274 A * 4/1997 Wear ..... A63H 33/006 40/617
D392,695 S * 3/1998 Haupt ..... D21/476
5,823,844 A * 10/1998 Markowitz ..... A63H 11/02 119/707
6,038,812 A * 3/2000 Belokin ..... A01G 5/04 229/123.2
6,113,455 A * 9/2000 Whelan ..... A63H 33/006 248/214
6,413,141 B1 * 7/2002 Putney ..... A63H 33/006 446/227
6,447,362 B2 * 9/2002 Khamphilavong .. A63H 33/006 40/455
6,475,057 B1 * 11/2002 Norman ..... A63H 33/006 446/227
6,482,066 B1 * 11/2002 Kelly ..... A63H 33/006 248/214
6,591,529 B1 * 7/2003 Lane ..... G09F 1/10 40/617
6,606,768 B2 * 8/2003 Henry ..... A45F 5/00 24/298
6,629,727 B2 * 10/2003 Asbach ..... B60N 2/2821 297/188.06
6,682,389 B2 * 1/2004 Wells ..... A63H 33/006 40/593
6,769,952 B1 * 8/2004 Drosendahl ..... A63H 33/006 446/227
6,845,579 B2 * 1/2005 Weiser ..... G09F 19/08 40/427
7,025,654 B2 * 4/2006 Oren ..... A63H 33/006 446/227
7,137,221 B2 * 11/2006 Highby ..... A01M 31/06 43/2
7,476,142 B2 * 1/2009 Mastrosimone-Gese ..... A63H 33/006 446/227
7,523,574 B2 * 4/2009 Henick ..... G09F 7/18 40/617
7,661,636 B1 * 2/2010 Burke ..... A61J 9/06 248/102
7,788,836 B2 * 9/2010 Vincent ..... A47F 5/04 211/205
7,895,779 B2 * 3/2011 Schnuckle ..... A63H 13/02 119/708
D650,591 S * 12/2011 Vincent ..... D6/306
8,464,448 B2 * 6/2013 Palmer ..... G06Q 30/0225 40/617
8,484,883 B2 * 7/2013 Rogers ..... A01M 31/06 43/2
8,628,375 B2 * 1/2014 Jeong ..... A63H 33/006 446/227
8,771,033 B2 * 7/2014 Goszewski ..... A63H 33/006 446/227
D733,607 S * 7/2015 Paulson ..... D11/141
2002/0094748 A1 * 7/2002 Baik ..... A63H 33/006 446/227
2005/0170743 A1 * 8/2005 Wells ..... A63H 33/006 446/227
2005/0197040 A1 * 9/2005 Babbidge ..... A63H 33/006 446/227
2006/0178082 A1 * 8/2006 Saade ..... A63H 33/006 446/227
2008/0248714 A1 * 10/2008 Zacharias ..... A63H 33/006 446/228
2010/0311303 A1 * 12/2010 Oren ..... A63H 33/006 446/227
2012/0100776 A1 * 4/2012 Jackson ..... A63H 33/006 446/227
2012/0276805 A1 * 11/2012 Muscarella ..... A63H 33/006 446/227
2013/0178131 A1 * 7/2013 Wudtke ..... A63H 13/06 446/129
2014/0065925 A1 * 3/2014 Oren ..... A63H 33/22 446/227
2014/0242872 A1 * 8/2014 Kim ..... A63H 33/006 446/227

* cited by examiner

MOBILE KIT THAT REVOLVES FROM A CEILING FAN

CROSS-REFERENCE TO RELATED APPLICATIONS

This non-provisional utility patent application claims the benefit under 35 USC § 119(e) of provisional patent application No. 61/814,762 filed Apr. 22, 2013, also referenced on the application data sheet under 35 USC § 119(e) accompanying this specification.

BACKGROUND OF THE INVENTION

Up until now there have only been two types of mobiles. The first type of mobile is powered by its own motor that either winds-up or is battery operated as seen mostly over children's cribs. This type of mobile with its symmetrically placed ornaments and ridge structural balance is permanently balanced. The second type of mobile is generally called a kinetic mobile. A kinetic mobile moves randomly in no set direction, up and down, back and forth from a breeze or draft. A kinetic mobile is carefully pre-balanced and any change of location of any of its parts would upset its delicate balance. Mobiles require careful balancing especially with kinetic mobiles. This takes skill and is very time consuming balancing a kinetic mobile especially if it has ornaments. The ornaments of a kinetic mobiles are permanently attached and cannot be added or relocated or removed because the delicate balance of the mobile would be destroyed.

The mobile of the present invention is a new and unique type of mobile that suspends and revolves from the airflow of an electric ceiling fan in a consistent direction and can be easily balanced and rebalance. There are several unique features of the mobile of the present invention. The mobile can have an ornament or ornaments that do not have to be symmetrically located on the mobile. The mobile can have an ornament or ornaments that can be added or removed or relocated to any location on the mobile and the mobile can be quickly and easily balanced and rebalanced making adding or relocating or removing an ornament or ornaments possible and very easy. The mobile of the present invention will continue to be able to revolve from the airflow of a ceiling fan with any changes made. This enables the creation of a uniquely personal and interactive mobile creating the opportunity for a wide selection and choice of placement of decorative ornaments from which a uniquely personalized mobile can be created, and changed or rearranged again and again!

The mobile kit of the present invention becomes an attractive part of a room's décor adding beauty, knowledge, inspiration, fun and whimsy while enabling a wide variety of themes and interests in the mobile's design and ornaments, by way of example, but not limited to: birds, boats, airplanes, cars, butterflies, insects, fish, animals, human figures, pixies, dragons, mythical creatures, imaginary creations, cartoons, flowers, leaves, branches, clouds, waves, stars, comets, scenery, sport activities, vocational interests, nature themes. These mobiles with their varying interests and themes are not limited to the home, but can be used where ever ceiling fans are used: homes, offices, work places, schools, barns, nursing homes, hospitals, fire departments, military bases, marinas, airports, factories, shopping malls, show rooms, etc., etc. These mobiles with their ease of balancing would make a wonderfully exciting and creative craft project as well as being educational! These mobiles can excite creativity in the designing and arrangement of a very personal and expressive mobile!

The mobile kit of the present invention literally and figuratively is a cool, unique and beautiful way to decorate a room with an abundance of themes and interests that can be easily changed while still enabling easy balancing and rebalancing of the mobile, a unique feature of the present invention.

Studies have shown that good air circulation is good for one's health and that a fan in an infant's room can help prevent Infant Death Syndrome.

Accordingly, the present invention provides a mobile kit for use with a ceiling fan that meets these needs.

DISCUSSION OF PRIOR ART

The following patents and patent applications are representative of mobile kits that may be attached to ceilings or ceiling fans:

U.S. Pat. No. 4,567,682 (Hurxthal) describes a mobile sculpture and kit for its manufacture are provided wherein a plurality of pairs of photographs, in back-to-back relationship, with respect to one another, are suspended in air, in spaced-apart location, each pair of photographs being removably replaceable from a holder for the pair of photographs so that other pairs of photographs can be substituted from time-to-time.

U.S. Pat. No. 5,097,398 (Dye) describes a decorative lighting and rotating display fixture kit comprises a support frame for mounting the fixture to a ceiling fan, a shroud concealing the support frame, and at least one electrical light socket mounted within the shroud. A motor is mounted to extend below the support frame shroud, is concealed by a decorative motor shroud, and supports a decorative display or carousel for rotation about a vertical axis. Electrical wiring connects the light socket and the motor to the ceiling fan wiring. A switch attached to the support frame and connected to the electrical wiring controls electrical energy to the fixture kit. The fixture kit may be mounted directly to the ceiling or other wiring location as a separate fixture, without the ceiling fan.

U.S. Pat. No. 6,464,555 (Paduano) describes mobiles which have an articulated array of arms connected to a central hub and artifacts attached to the outer, distal ends of the arms by strap-type fasteners. The hub can be rotated by a battery-powered or a spring-type motor as selected by a user of the mobile. The hub of the mobile is attached to a vertically extending support having a flexible segment by a ball and joint connector. A clamp at the lower end of the support is employed to fix the support to a suitable and available structure.

U.S. Pat. No. 6,591,529 (Lane) describes a support assembly in a decorative structure includes at least two suspended elements. The support assembly includes a support tube having a hollow interior and opposed end portions. In an embodiment, a pair of selectively removable adjustment are adapted to interlock with a respective end portion of the support tube. A flexible, elongate support element is secured between each of the clips and the respective end portions of the support tube. The elongate support element has two ends, each of the ends being adapted for attachment to a suspended element of the decorative structure. The adjustment clips can be adapted to fit over the end portions of the support tube, which can be constructed as a hollow cylindrical tube. In an illustrated embodiment, the adjustment clips comprise annular cylindrical members having an inner diameter approximately equal to an outer diameter of the support tube. In another embodiment, the elongate support element is secured in slits on the respective ends of the support tube. The elongate support element can be provided as a string, for example, monofilament. The support tube and/or the adjustment clips can be fabricated from a transparent material. The support tube can be provided with a substantially arcuate shape. A method of securing suspended elements to a support assembly in a decorative structure including at least two suspended elements is also set forth.

U.S. Pat. No. 6,971,854 (Krakowski) describes a mobile kit for use with a ceiling fan, the kit comprising a plurality of fan ornament assemblies, each fan ornament assembly including a collar device adapted for attaching to a fan blade, a support cord having a first end and a second end, the first end attached to the collar device, an ornamental object attached to the second end of the support cord. The support cord is adapted to suspend ornamental object when the collar device is attached to the fan blade.

U.S. Pat. No. 7,311,421 (Fahl) describes an ornament having an upper hub, a lower hub, a platform, a central pole and a coil. The upper hub is mounted directly on top of the lower hub with the platform permanently attached to the lower hub for attachment to virtually any smooth surface. The coil wraps around the pole, which is threaded and mates with internal grooves in the upper hub. The coil includes a string of lights plugged into an electrical outlet in the upper hub. The upper hub freely rotates with respect to the lower hub, which remains stationary. To maintain electrical contact between the lights and a power supply, copper tabs protrude from the lower hub and extend into copper rings in the upper hub.

U.S. Pat. Application 2006/0165529 (Sobel) describes an air circulation system-driven, suspended rotating display device includes an attachment member and a rotatable member. The attachment member has an upper end and a lower end, and a component for attachment proximate a ceiling fan or, alternatively, proximate an air vent. The attachment component is located at the upper end, and has a swivel joint for attachment to a rotatable member. The rotatable member has a frame, a sign connected to the frame and at least one air vane connected to frame for acting like a turbine to cause circulating air to spin the rotatable member with its sign.

U.S. Pat. Application 2010/0316495 (Todd) describes a lighting and heating assembly is provided. The lighting and heating assembly is configured for mounting to an existing ceiling fan. The lighting and heating assembly includes a lighting assembly for distributing light and a heating assembly for providing heat to the air circulated by the ceiling fan. The lighting assembly is attachable to the ceiling fan and has the heating assembly detachably connected thereto, which allows the lighting assembly to be used without the heating assembly. Additionally, the lighting and heating assembly is adjustable such that the lighting assembly and/or heating assembly are repositionable at desired locations in relation to one another and the air flow generated by the ceiling fan.

Notwithstanding the prior art, the present invention is neither taught nor rendered obvious thereby.

SUMMARY OF THE INVENTION

The present invention relates to a mobile with adjustable balance that suspends and revolves from the airflow of an electric ceiling fan. The mobile of the present invention can have one or more removable ornaments that can be relocated or added or removed or a combination thereof and the mobile can be repeatedly and easily rebalanced. The mobile of the present invention suspends from a generally central location of the ceiling fan, below the fan blades not on the fan blades.

Let it be understood that the term "co-operatively attaches", "co-operatively attached", "co-operatively attach" will be used in the patent of this invention to mean an element of the mobile that "removably or non-removably attaches".

The mobile kit of the present invention has a balancing platform with an attachment means. The attachment means being a screw eye or a swivel eye generally centrally located on the balancing platform for cooperatively attaching to the fan attachment device. The balancing platform can be made for example from wood or plastic. The balancing platform can be planar or three-dimensional.

The mobile kit includes a fan attachment device that is intermediate the balancing platform of the mobile and the ceiling fan's attachment point. The fan attachment device can be made from a variety of flexible materials such as; swivel chain, nylon line, string, fishing line, ribbon. The fan attachment device having an attachment means to cooperatively attach to the balancing platform and the ceiling fan's attachment point. The preferred embodiment of a fan attachment means for both ends of the fan attachment device is a swivel & hook combination comprising: a swivel with an attachment eye and a hooking means. Both can be removably attached to a swivel chain by a removable clasp or the swivel and hook that attaches to the balancing platform end of the fan attachment device can be permanently attached to the fan attachment device. The other end of the fan attachment device has two interchangeable attachment means comprising a removable clasp and a swivel with the swivel eye and hook. These two interchangeable attachment means removably attach to the fan's swivel pull chain or hook over or to a structure of the ceiling fan. This is desirable because one fan attachment device can be used on two different types of ceiling fans—ceiling fans with or without swivel pull chains. The fan attachment device comprising a swivel chain can also be easily lengthened or shortened. Another attachment clasp can be used to connect to another section of swivel chain. Swivel chain is also easily cut to the desired length.

If for example a string, nylon line, fishing line, or ribbon are used as a fan attachment device than the two swivels with an attachment eye and hook can be tied on to each end of the fan attachment device. One or both swivels and hooks can be tied on by the user at the desired length. This type of fan attachment device could also tie directly to the balancing platforms's attachment means.

A fan attachment band is an adhesive band or one or more elastic bands used to attach to the lower hub of the ceiling fan for attaching a fan attachment device when there is no structural element or swivel pull chain for attachment purposes on the ceiling fan.

The main body of the mobile kit consists of a display structure or display structures with multiple attachment points for ornaments and multiple attachment points for the bridle or bridles. A display structure can be planar or three dimensional. A display structure can be ridge or flexible or a combination thereof. A display structure can be round or oval or geometric or radial. Multiple display structures suspended from one another can each have their own balancing platform or they can share a balancing platform. Multiple display structures can be cooperatively attached to each other by an attachment line intermit the display structure above and the attachment means of the balancing platform of the display structure below. The attachment line has an attachment means at both ends for attaching to a corresponding attachment device on the display structure such as a hook or screw eye or the attachment line wraps around a structural element of the above display structure and connects to itself. Display structures can also be cooperatively attached by tying or wiring through the attachment means of the balancing platform below and the display structure above.

The display structure of the present invention can be decorative. The display structure can have incisions for the cooperative attachment of an ornament or ornaments. The display structure can have structural elements for ornament to co-operatively attach. The display structure is constructed from generally lightweight materials for example but not limited to; oaktag, balsa wood, museum board, foam board, cardboard, paper, vellum, fabrics, wood, wire, plastic, rubber or a combination thereof. The display structure can have one or more bridles. Depending on the attachment points of a bridle some display structures may have one or more balancing structures for enabling generally vertical balance in cooperation with a bridle. The balancing structure is used when the location of the bridle makes the display structure top heavy. There are generally five types of display structures:

A generally horizontal, planar display structure of the present invention can be decorative on one or both sides. A planar display structure can be an irregular shape.

A three-dimensional display structure of the present invention can be flexible or ridge or a combination thereof. Multiple sequential three-dimensional display structures if co-operatively attached close enough together can have interlocking elements on the display structure that can create and maintain a radial pattern. A three-dimensional display structure can be irregularly shaped.

A round and oval display structure of the present invention requires two or more bridles and a supporting rim which can be made for example from: wire, plastic, foam board, oaktag, cardboard, natural materials.

A radial display structure of the present invention requires two or more bridles and two or more overlapping support structures making a cross or radial pattern.

The bridle or bridles of the mobile of the present invention can cooperatively attach to the display structure and adjustably thread across the balancing platform. The bridle or bridles slide preferably through perforations in the balancing platform giving the display structure its generally horizontal balancing ability and the ability to rebalance the display structure when ornaments are added or removed or relocated or a combination thereof. The bridle can also work in conjunction with one or more balancing structures of the display structure to give a top heavy display structure generally vertical balance. A securing tape releasably secures the bridle to the balancing platform to help prevent slippage, but still allowing adjustments to be made. Alternative releasing securing means for example can be a clip or wrapping the bridle around a structure element of the balancing platform. The bridle can be made from a variety of materials for example but not limited to; fishing line, nylon line, thread, ribbon, string. The bridle or bridles can be decorative with planar or three-dimensional objects in areas that do not interfere with balancing adjustments.

The mobile kit of the present invention has ornaments. The ornaments of the present invention can be planar and three-dimensional. The ornaments of the present invention can be decorative The ornaments of the present invention are constructed from generally lightweight materials for example but not limited to; paper, vellum, oaktag, cardboard, structural foam, plastic, fabrics, wire, thread or a combination thereof. The ornaments of the present invention can be removably attached to the main display structure or a combination of removable and non-removable ornaments can be attached to the display structure. The ornaments of the present invention can have a plurality of attachment points for the co-operative attachment of tethers or bridles or wires. Tethers or bridles or wire can permanently attach to an ornament by way of example; tying or gluing or gluing between coversheets or a combination thereof.

There are two major types of ornaments of the mobile of the present invention. There are ornaments that randomly spin and move and ornaments that do not randomly spin, but can be angled and faced in a given direction.

The first type of spinning ornaments that cooperatively attaches to the display structure are ornaments that randomly spin and move. They dangle from the display structure by a single tethering line. One or more ornaments can be cooperatively attached to a single tethering line.

A second type of spinning ornament that dangles and randomly spins and moves are two ornaments at each end of a tethering line. This tethering line may also have more than two ornaments.

The third type of spinning ornament that dangles and randomly spins and moves is an ornament or ornaments that are attached to a bridle and tethering line combination.

The second major type of ornaments are the most unique. They do not randomly spin and are relatively stable. They can be given a specific angle and faced in a given direction.

The first major type of ornament of the present invention that does not randomly spin but is relatively stable is an ornament suspended from the display structure by a bridle. It is the bridle configuration that balances the ornament and enables the ornament to generally face in a given direction and be given a specific angle all without random spinning. The wider apart the bridle is at the display structure's attachment point, the more stability the ornament will have. A single bridle configuration can have two or more attachment lines to an ornament.

The second major type of ornament that does not randomly spin but is relatively stable is an ornament supported in mid-air by a wire. The wire allows the ornament to be angled and faced in any desired direction. The wire of the mid-air ornament can wrap around or clip to the display structure.

Lastly the display structure can have an ornament that is not suspended or supported in mid-air but cooperatively attaches directly to the display structure.

All of these ornaments can have one or more ornaments co-operatively attached to them by a tethering line, bridle or wire or a combination thereof. This enables a sequential series of ornaments. A sequential series of ornaments can be removably attached. Ornaments can have ride on figures and carry removable objects.

The tethering line or bridle or wire of these removable ornaments attaches to the display structure in several ways and are not limited to: hooks or loops, clips, wrapping or looping or draping over elements of the display structure, or inserting the bridle or tether into an incision or incisions in the display structure or any combination thereof. If a sequential series of ornaments are permanently attached for example by tying or gluing it would be considered as one ornament.

To prevent a tethering line from slipping through an incision a planar or three-dimensional object is attached at the end of the tethering line. In the case of a bridle as well as a tethering line with an ornament at each end, the object is attached in a generally central location on the bridle and between the two end ornaments on the tethering line. Since tethering lines and bridles can be difficult to see, these objects also make it easier to locate, and pick up an ornament for adding or removing or relocating an ornament on the display structure or a combination thereof.

The speed of the fan determines the speed that the mobile revolves. The faster the fan speed the faster the mobile revolves. However, the revolving speed of the mobile is considerably slower than the speed of the revolving fan blades.

There has thus been outlined, rather broadly, the more important features of the invention in order that the detailed description thereof that follows may be better understood. It is to be understood that the invention is not limited in scope or application to the details of construction or arrangements of the components set forth in the following drawings or description. The invention is capable of other embodiments and of being practiced and carried out in various ways. As such, those skilled in the art will appreciate that the conception upon which this disclosure is based may readily be utilized as a basis for the designing of other methods, assemblies and devices for carrying out the several purposes of the present invention.

BRIEF DESCRIPTION OF THE DRAWINGS

Other features of my invention will become more evident from a consideration of the following brief descriptions of the patent drawings accompanying this specification.

DETAILED DESCRIPTION

The detailed description set forth herein with the appended drawings is intended as a description of an exemplary embodiment and is not intended to represent the only forms of the embodiment of the present invention.

Figure 1:
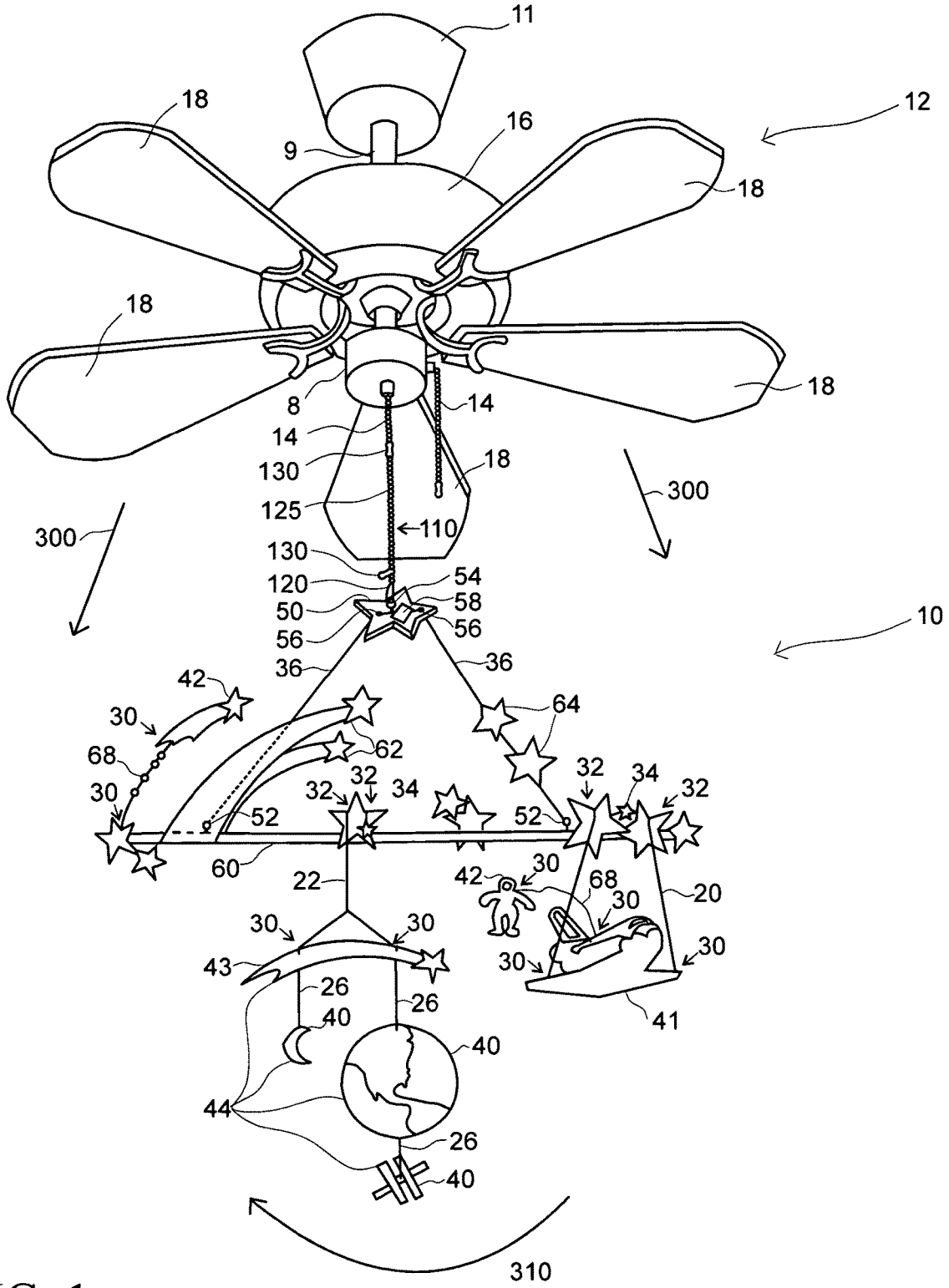
FIG. 1 is a frontal perspective view of an illustrative ceiling fan with a revolving planar mobile kit with one bridle and attached in accordance with one embodiment. The mobile kit having ornaments.

FIG. 1 shows a perspective view of an illustrative conventional electric ceiling fan 12 with a motor 16, a plurality of fan blades 18, a ceiling attachment cap 11, a suspension rod 9, a capping hub 8, and two swivel pull chains 14 to which a lightweight mobile kit 10 in accordance with one exemplary embodiment of the invention is removably attached below the fan blades 18 and not to the fan blades 18. The mobile 10 revolves 310 from the airflow 300 of the fan bladed 18 when the ceiling fan 12 is activated.

The mobile kit 10 of this invention revolves 310 from the air flow 300 from the fan blades 18 of the ceiling fan 12. Preferably revolves 310 in the direction of the fan blades 18. Ceiling fans 12 can have different controllable speeds and the mobiles 10 of this invention revolve faster with a faster fan speeds and slower with a slower fan speeds. However, the revolving speed of the mobile is considerably slower than the revolving speed of the fan blades. The revolving speed of the mobile 10 can also be slowed down by lengthening the fan attachment device 110.

FIG. 1 shows an exemplary embodiment of a mobile kit 10 consisting of a decorative irregularly shaped planar display structure 60 with a plurality of attachment points being incisions 32 for the co-operative attachment of ornaments 40, 41, 42, 43. The mobile 10 being decorative on both sides of the planar display structure 60 with a starry decorative design and having two comets being balancing structures 62. The bridle 36 of the display structure 60 threads through perforations 56 in the balancing platform 50 in the shape of a star and is releasably secured by a securing tape 56. The bridle 36 attached to the display structure 60 by way of two screw eyes 52. The bridle 36 is also decorated with two stars 64. The bridle 36 threads through perforations 56 in the balancing platform 50. The balancing platform 50 through can be planar or three-dimensional. The balancing platform 50 has a screw eye 54 for co-operatively attaching to a fan attachment device FIG. 8, 110. The balancing platform 50 has a securing tape 58 for preventing destabilizing slippage of the bridling line 36, but still allowing adjustments to be made.

The exemplary display structure of the mobile kit 10 has ornaments, 41 and 42 and 43. Ornament 41 in the shape of the space shuttle is suspended by a bridle 20 from incisions 32 in the display structure 60. The bridle 20 attaches 30 to the space shuttle. The bridle 20 of ornament 40 has an object 34 in the shape of a star to prevent slippage through the incision 32. The ornament has another ornament 42 in the shape of an astronaut suspended in air by a wire 68 at attachment points 30.

The display structure 60 has an ornament 42 in the shape of a star supported in mid-air by a wire 68 with beads. The ornament 42 shows attachment points 30 on the ornament 42 and on a structural element of the display structure 60 in the form of a star.

The display structure 60 has an ornament 43 with a tether and bridle 22 and an object 34 in the shape of a star to prevent slippage of the tether and bridle 22 through the incisions 32 of the display structure 60. The ornament 43 in the shape of a shooting star suspends from a bridle and tether 22. Other ornaments 40 co-operatively attach 30 by a tether 26 to create a sequential effect. This ornament 43 with tether and bridle 22 can be a single ornament or have sequential ornaments 40 with tethers 26 cooperatively attached.

Figure 2:
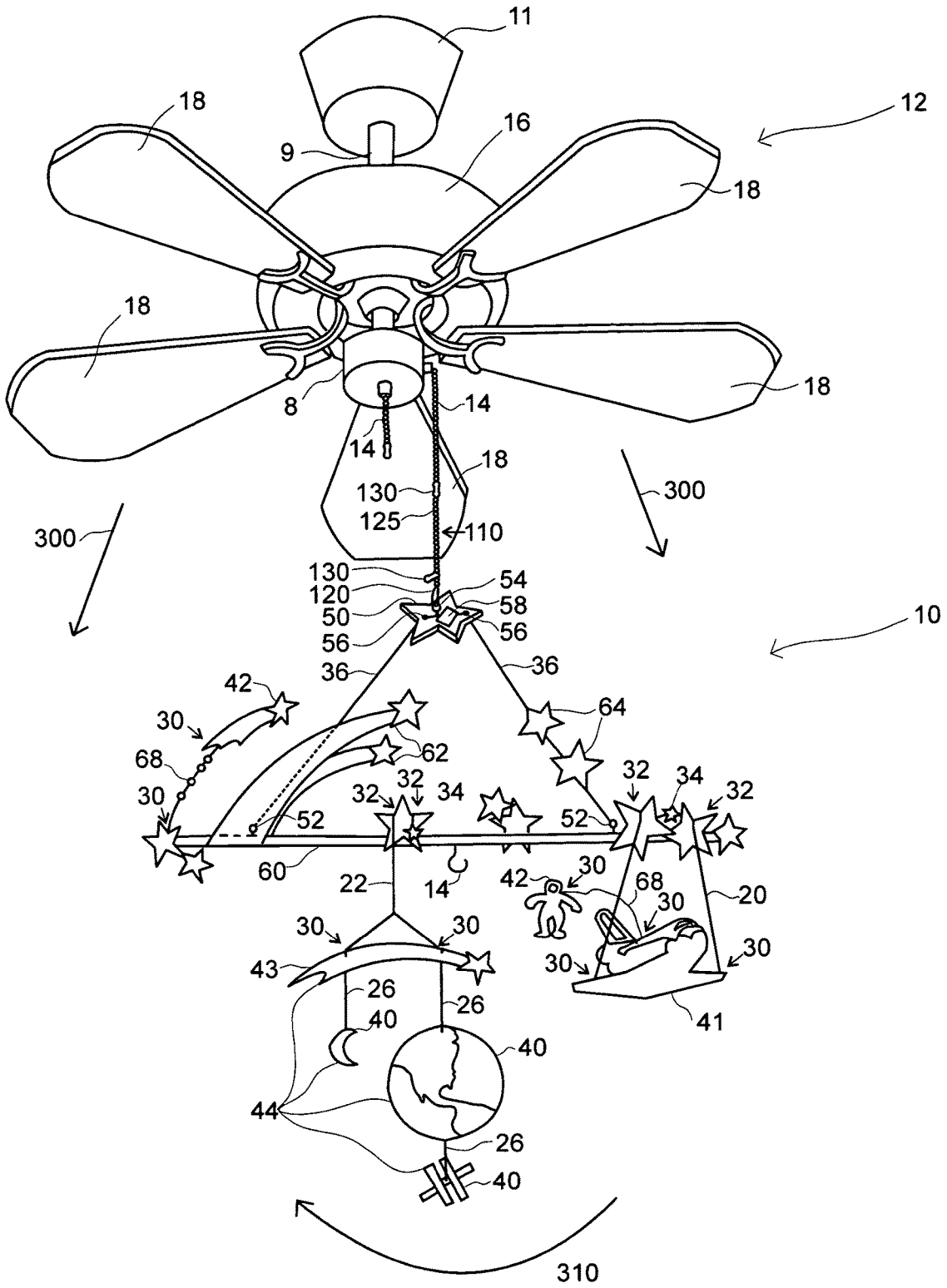
FIG. 2 is a frontal perspective view of an illustrative ceiling fan with a revolving planar mobile kit with one bridle attached in accordance with one embodiment. The planar mobile kit having a hook for sequential attachment of another mobile kit.
Figure 13:
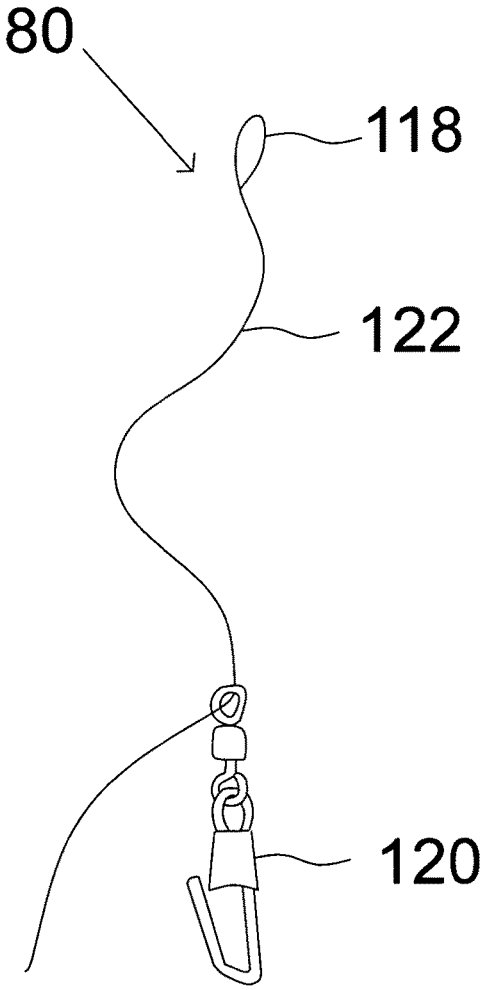
FIG. 13 is a frontal view of an illustrative attachment line for connecting a sequential mobile kits in accordance with one embodiment.

FIG. 2 shows the exemplar embodiment of FIG. 1 with the addition of a sequential mobile attachment device FIG. 13, 14 being in the form of a hook.

Figure 3:
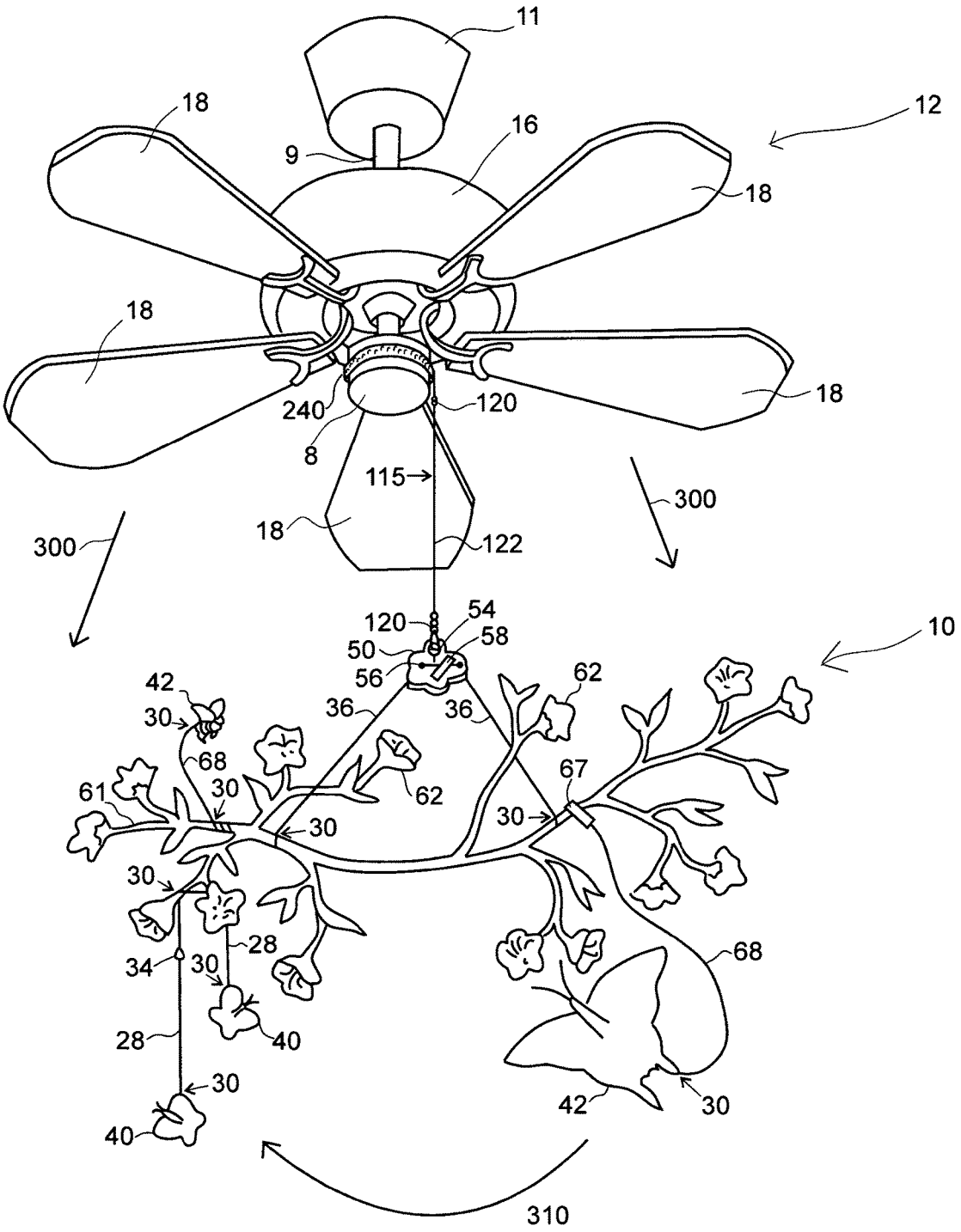
FIG. 3 is a frontal perspective view of an illustrative ceiling fan with a revolving three-dimensional mobile kit with one bridle and attached in accordance with one embodiment. The mobile kit having ornaments.
Figure 10:
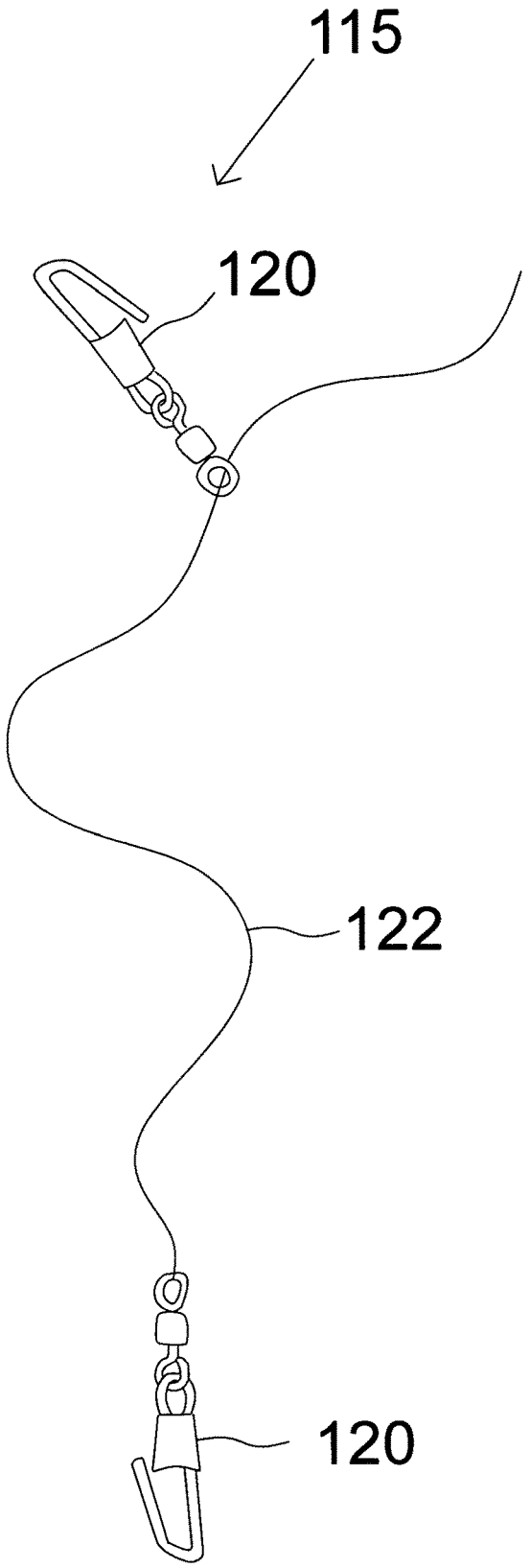
FIG. 10 is a frontal view of an illustrative fan attachment device having a tethering line with one attached swivel and hook and another swivel and attachable in accordance with one embodiment.
Figure 11:
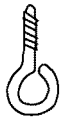
FIG. 11 is a frontal view of an illustrative screw eye.

FIG. 3 shows an exemplary embodiment of mobile kit 10 with a three-dimensional display structure 61 being removably attached to a ceiling fan 12 by means of a fan attachment device FIG. 11, 110. The fan attachment device FIG. 11, 115 removably attaching to the ceiling fan 12 by hooking 120 to a fan attachment band 240. The three-dimensional display structure 61 being in the form of a flexible flowery branch and being suspended from a single bridle 36 that tires to the display structure 61 at attachment points 30. The display structure 61 having balancing structures 62 in the form of smaller flowery branches. The bridle 36 being threaded through the perforations 56 in the balancing platform 50 in the shape of a flower and releasably secured by a securing tape 58. The swivel and hook FIG. 10, 120 of the fan attachment device FIG. 10 is removably attached to the screw eye 54 of the balancing platform 50.

The display structure 61 has two, three dimensional ornaments 42 supported in mid-air by a wire 68. The first three-dimensional ornament 42 in the shape of a butterfly is removably attaches to the display structure 61 by means of a clip 67 and the wire 68 attaches to the butterfly at a plurality of attachment points 30. The second three-dimensional ornament 42 in the shape of a bee is removably attached to the display structure 61 by wrapping the wire 68 at the attachment point 30 around a structural element of the display structure 61. The wire 68 attaches to the bee ornament 42 at the attachment point 30.

Figure 16:
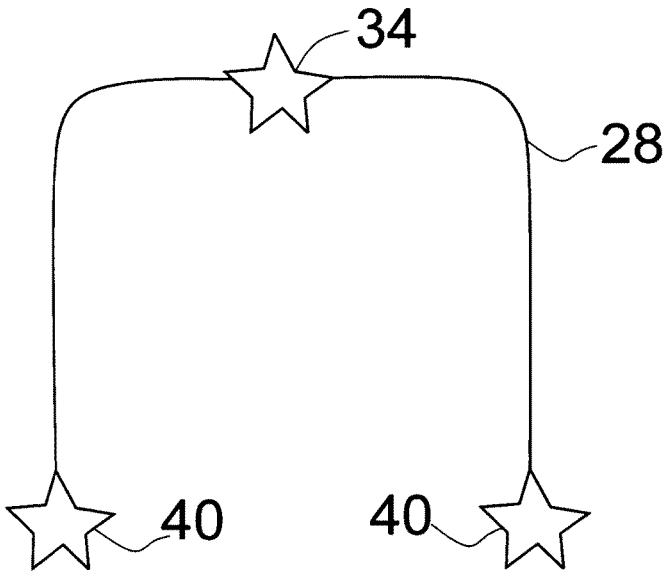
FIG. 16 is a frontal view of an illustrative ornaments three stars in accordance with one embodiment.

The third ornament FIG. 16, 40 in the form of two dangling three-dimensional butterfly ornaments are draped over the display structure 61 at attachment points 30 by the tether 28. The tether 28 having an object 34 being a three-dimensional bead to help locate the tether 28 and prevent slippage.

Figure 4A:
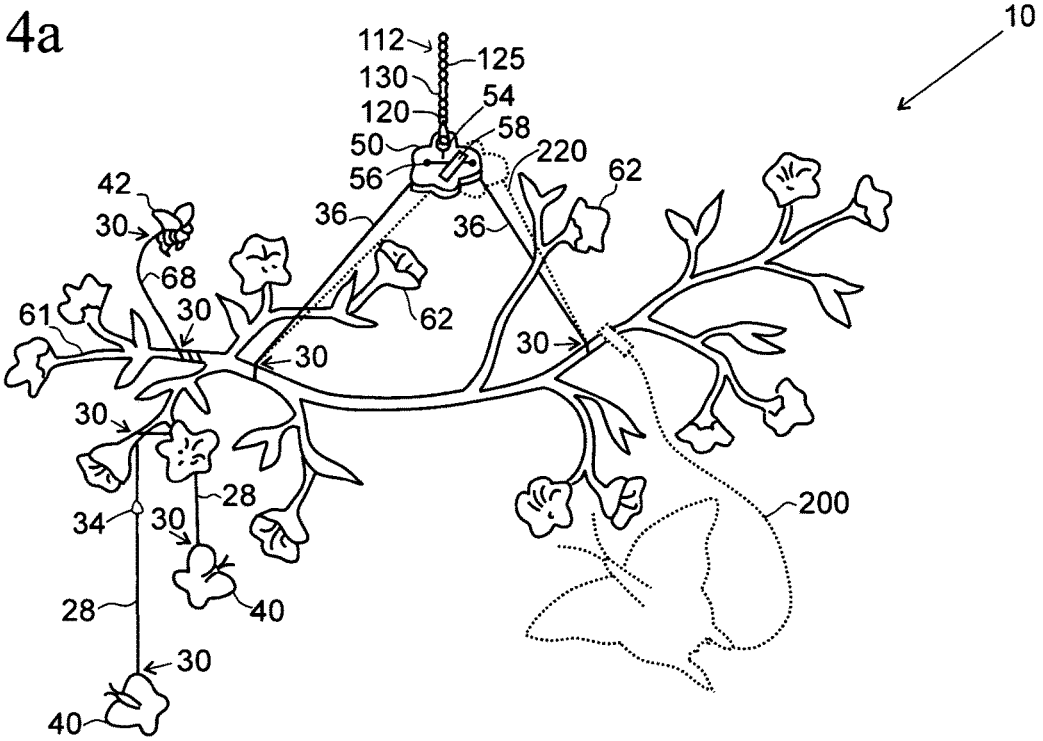
FIG. 4*a* is a frontal view of an illustrative three-dimensional mobile kit showing the removal of an ornament and the rebalancing of the mobile kit in accordance with one embodiment.

FIG. 4*a* shows an exemplar embodiment of the three-dimensional display structure 61 of FIG. 3. with the wire 68 supported butterfly ornament 42 being removed as shown by the dotted butterfly outline 200. The display structure having two balancing structures 62 in the form of smaller flowery branches. The display structure 61 is also shown being rebalanced 220 as illustrated by the dotted lines and the fan attachment device of FIG. 3 being FIG. 10, 110 has also been change to a swivel chain, fan attachment device FIG. 9, 114.

Figure 4B:
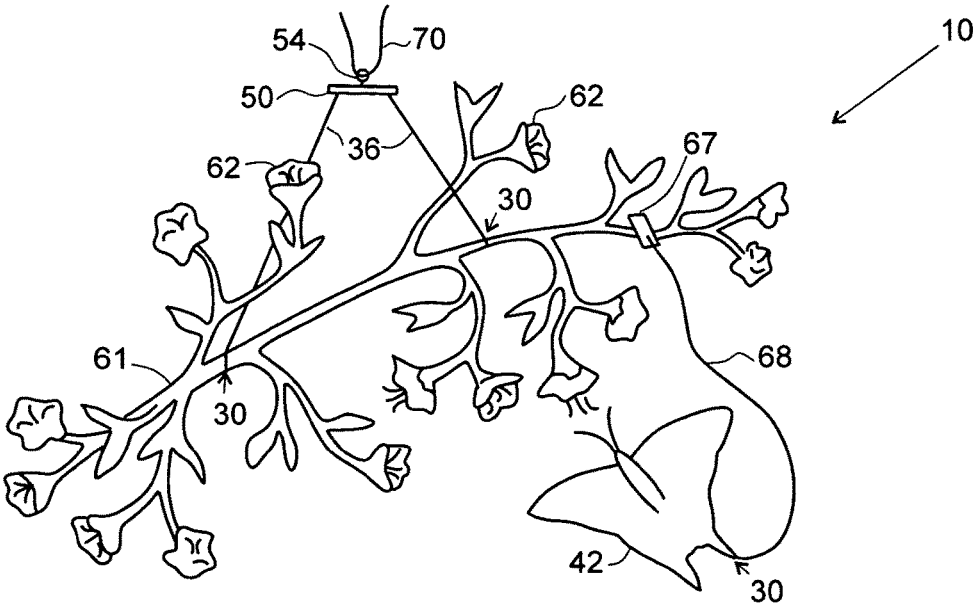
FIG. 4*b* is a frontal view of an illustrative three-dimensional mobile kit showing an attachment means for co-operatively attaching to the above mobile kit in accordance with one embodiment.

FIG. 4*b*. shows an exemplar embodiment similar to the three-dimensional display structure 61 of FIG. 4,*a*, being a flexible flowery branch with a single ornament 42 being a butterfly supported in mid-air by a wire 68 and removably attached to the display structure 61 by a clip 67. The display structure 61 having two balancing structures 62 in the form of smaller flowery branches. The balancing platform 50 being in a generally horizontal position with an attachment wire 70 threading through the screw eye 54 of the balancing platform 50 to removably attach to the above flowery three-dimensional display structure FIG. 4,*a*, 61.

Figure 5:
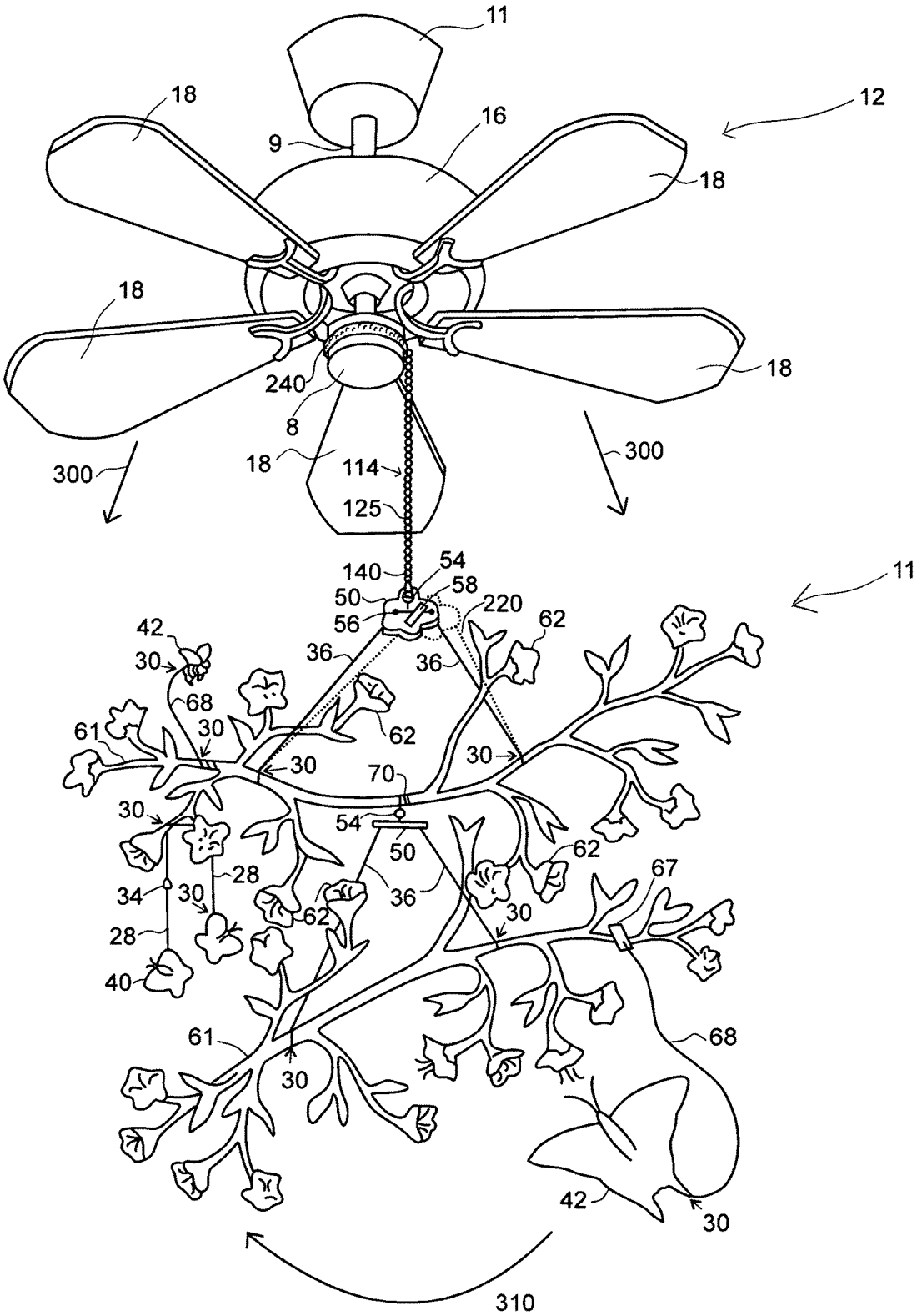
FIG. 5 is a frontal perspective view of an active ceiling fan with a revolving interlocking sequential three-dimensional mobile kit in accordance with one embodiment.

FIG. 5 shows the exemplary embodiment of FIG. 4,*a*, 61 and FIG. 4,*b*, 61 removably attached together by the attachment wire 70 creating a sequential mobile 11. The sequential mobile 11 is than rebalanced 220 as illustrated by the dotted line. Depending on the design, structural elements of the sequential mobiles 11 can interlock to create a generally radial pattern with each display structure 61 having its own balancing platform 50. The sequential mobile 11 being shown removably attached to a fan attachment band 240 by a swivel chain fan attachment device FIG. 9, 114. However a lightweight sequential mobile 11 can also be removably attached to a swivel pull chain FIG. 1, 14, of a ceiling fan 12. The mobile 11 revolves 310 from the airflow 300 from the ceiling fan 12.

Figure 6:
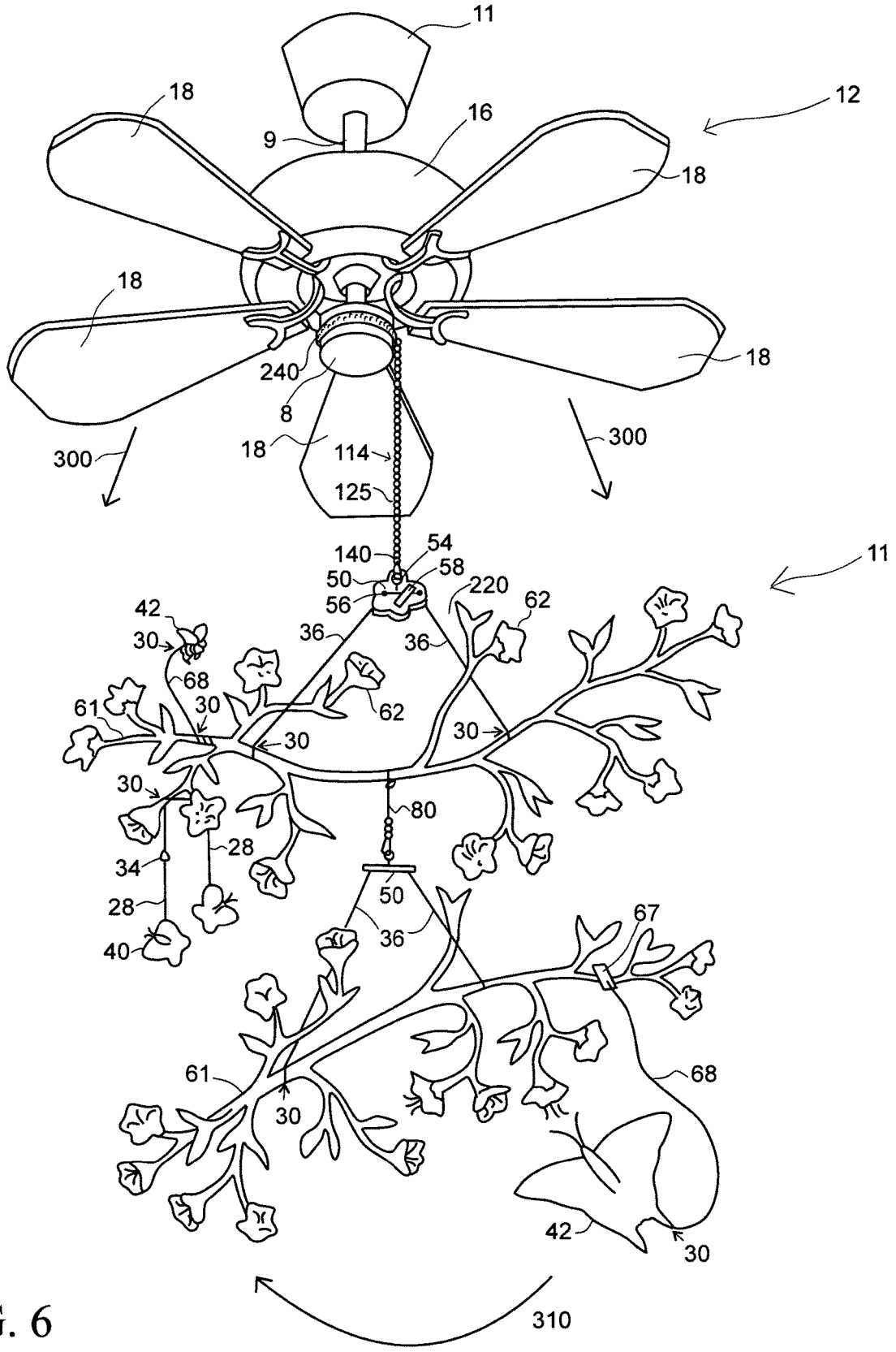
FIG. 6 is a frontal view of a ceiling fan with an active ceiling fan with a revolving sequential three-dimensional mobile kit not interlocking in accordance with one embodiment.
Figure 14:
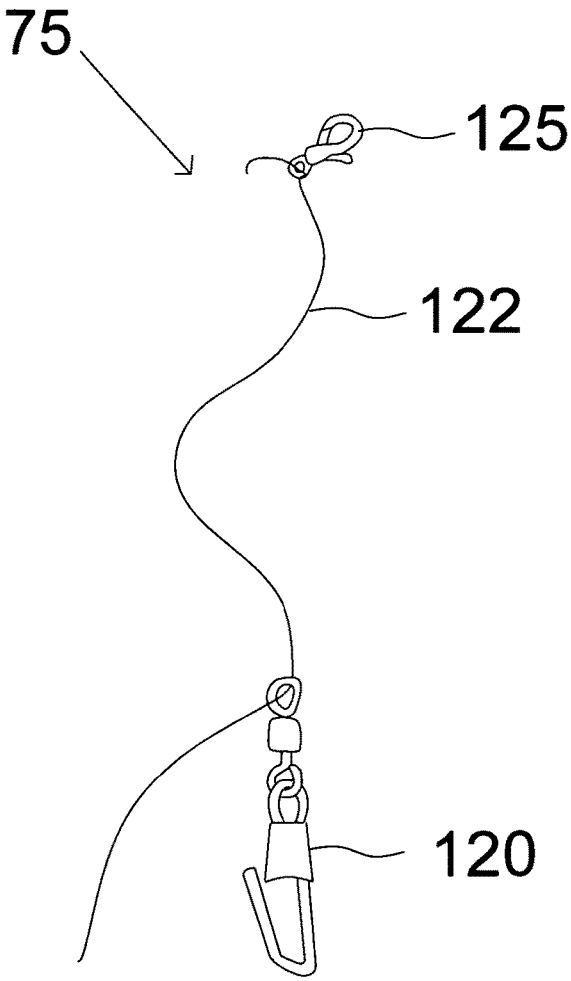
FIG. 14 is a frontal view of an illustrative attachment line for connecting a sequential mobile kit in accordance with one embodiment.

FIG. 6 shows and exemplary embodiment of a sequential mobile 11 removably attached by an attachment line FIG. 14, 75. The individual mobiles 61 that make up the sequential mobile 11 can revolve 310 independently of one another. The individual mobiles 61 do not interlock and each has its own balancing platform 50 for rebalancing when one or more ornaments 40, 41, 42, 43, 44 are added, relocated or removed or combination thereof.

Figure 7:
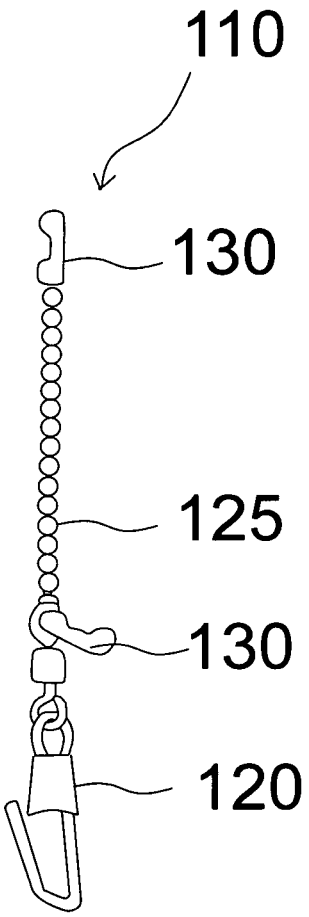
FIG. 7 is a frontal view of an illustrative swivel chain fan attachment device with an attachment clasp and attachment swivel and hook according to one embodiment.

FIG. 7 show and exemplary embodiment of a fan attachment device 110 being a swivel chain 125 with a removable attachment clasp 130 at the top for removably attaching to the ceiling fan's 12 swivel pull chain FIG. 1, 14. The swivel chain 125 has a removable attachment clasp 130 at the lower end to removable attach to the swivel and hook 120 comprising a swivel, with an attachment eye and hooking mechanism to removably attach to the screw eye 54 of the balancing platform 50.

Figure 8:
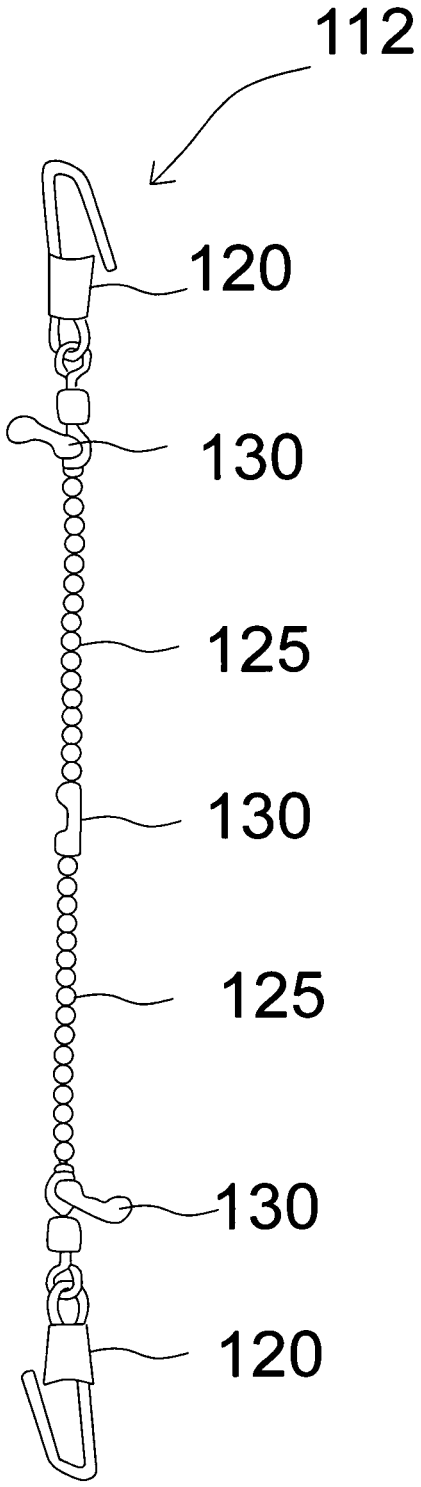
FIG. 8 is a frontal view of an illustrative swivel chain fan attachment device having to segments connected by and attachment clasp and two swivels and hooks at each end in accordance with one embodiment.

FIG. 8 shows and exemplar embodiment of a fan attachment device 112 being two swivel chains 125 connected by a removable clasp 130 to increase the length of the swivel chain 125. At the upper end of the swivel chain 125 is a removable attachment clasp 130 removably attached to a swivel and hook 120 comprising a swivel with and attachment eye and a hooking mechanism. Either the clasp 130 or the swivel and hook 120 can be used to removably attach to the ceiling fan 12. At the lower end of the swivel chain 125 is a removable clasp 130 that removably attaches to a swivel and hook 120 to removably attach to the balancing platform 50.

Figure 9:
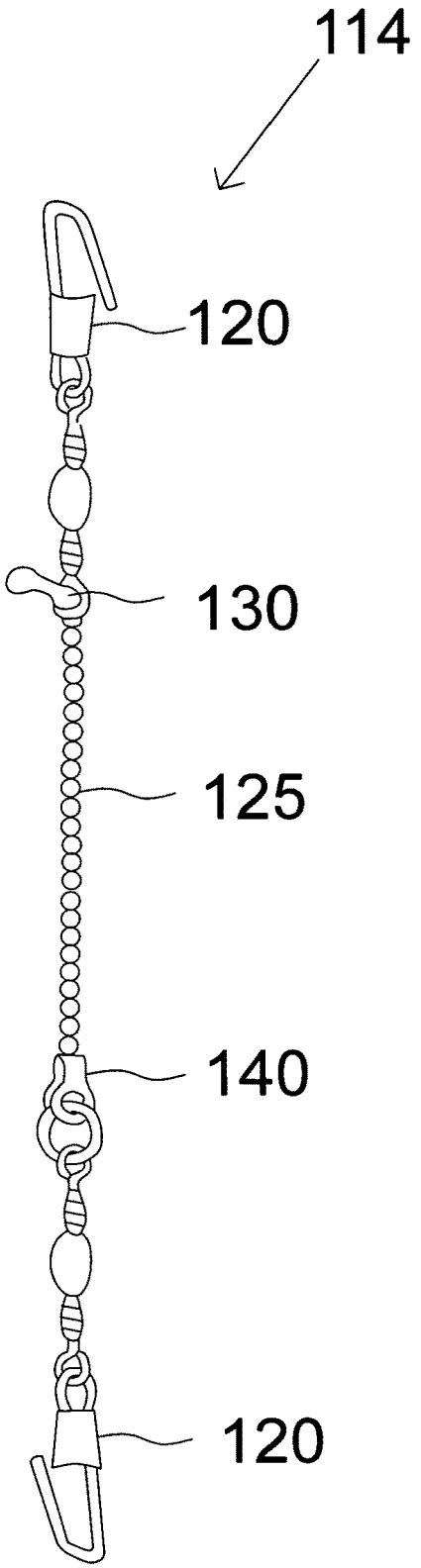
FIG. 9 is a frontal view of an illustrative swivel chain fan attachment device having a presentably attached swivel and hook at one end and a removable clasp and swivel hook at the other in accordance with one embodiment.

FIG. 9 shows and exemplar embodiment of a fan attachment device 114 being a swivel chain 125 with a removable attachment clasp 130 at the upper end removably attaching to swivel and hook 120. Either the clasp 130 or the swivel and hook 120 can be to removably attach to the ceiling fan 12.

FIG. 10 shows and exemplar embodiment of a fan attachment device 115 having a swivel and hook 120 tied to both ends of an intermediate attachment line 122 made of for example; string or nylon line, or thread or clear fishing line to removable attach to the balancing platform 50 and the ceiling fan 12.

FIG. 11 shows an exemplary embodiment of a screw eye FIG. 11 and FIG. 1, 54, 52. Screw eyes 54 are used to attach to the balancing platform 50 and preferably removably attach to the fan attachment device FIG. 7, 110, or FIG. 8, 112 or FIG. 9, 114 or FIG. 10. Screw eye FIG. 11 can be used to cooperatively attach bridles 36 to the display structure 60 as seen in FIG. 1, 52. Screw eyes FIG. 11 can be used to cooperatively attach display structures 10 to create a sequential mobile 11.

Figure 12:
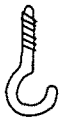
FIG. 12 is a frontal view of an illustrative hook.

FIG. 12 shows an exemplary embodiment of a hook FIG. 2, 14. The hook 14 is used to removably attach two or more display structures 10 to create a sequential mobile 11. Either a screw eye FIG. 11 or a hook FIG. 12 can be used in conjunction FIG. 14 or FIG. 13 or a wire FIG. 4,*b*, 70, to removably attach two or more display structures 10 to create a sequential mobile 11.

FIG. 13 show an exemplary embodiment of an attachment device 80 for removably attaching two or more mobiles 10 to create a sequential mobile 11. The intermediate attachment line 122 being made for example of clear fishing line or string or thread or nylon line. The attachment device 80 has an attachment loop 118 at the upper end for removably attaching to the higher mobile 10 and a swivel and hook 120 at the lower end for removably attaching to the balancing platform 50. of the lower mobile 10. The length of the attachment device 80 can be pre determined or decided by the user.

FIG. 14 shows an exemplary embodiment of an attachment device 75 for removably attaching two or more mobiles 10 having a hooking device 125 at the upper end for removably attaching to the higher mobile 10 and a swivel and hook 120 at the lower end for removably attaching to the balancing platform 50 of a lower mobile 10 to create a sequential mobile 11. The intermediate attachment line 122 for example can be; thread or string or clear fishing line and the length can be pre-determined or decided by the user.

Figure 15:
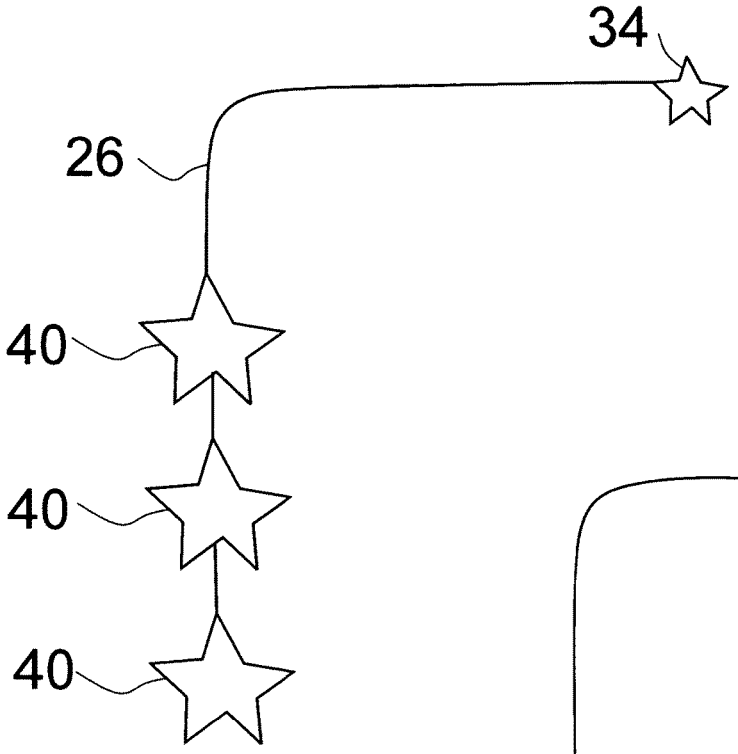
FIG. 15 is a frontal view of an illustrative ornament with four stars in accordance with one embodiment.

FIG. 15 shows exemplary embodiments of multiple ornaments 40 being planar stars attached to a single tether 26. The lower star 40 being tied to the tether 26 and a planar object 34 in the shape of a star being tied to the opposite end of the tether 26 to help prevent slippage and for easier tether 26 location. The other ornaments 40 are glued or taped or combination thereof.

FIG. 16 shows and exemplary embodiment of multiple ornaments 40 being planar stars attached at each end of a tether 28. A planar object 34 in the shape of a star being glued in a generally central location on the tether 28 to help prevent slippage of the ornaments 40 and for easier tether 26 location.

Figure 17:
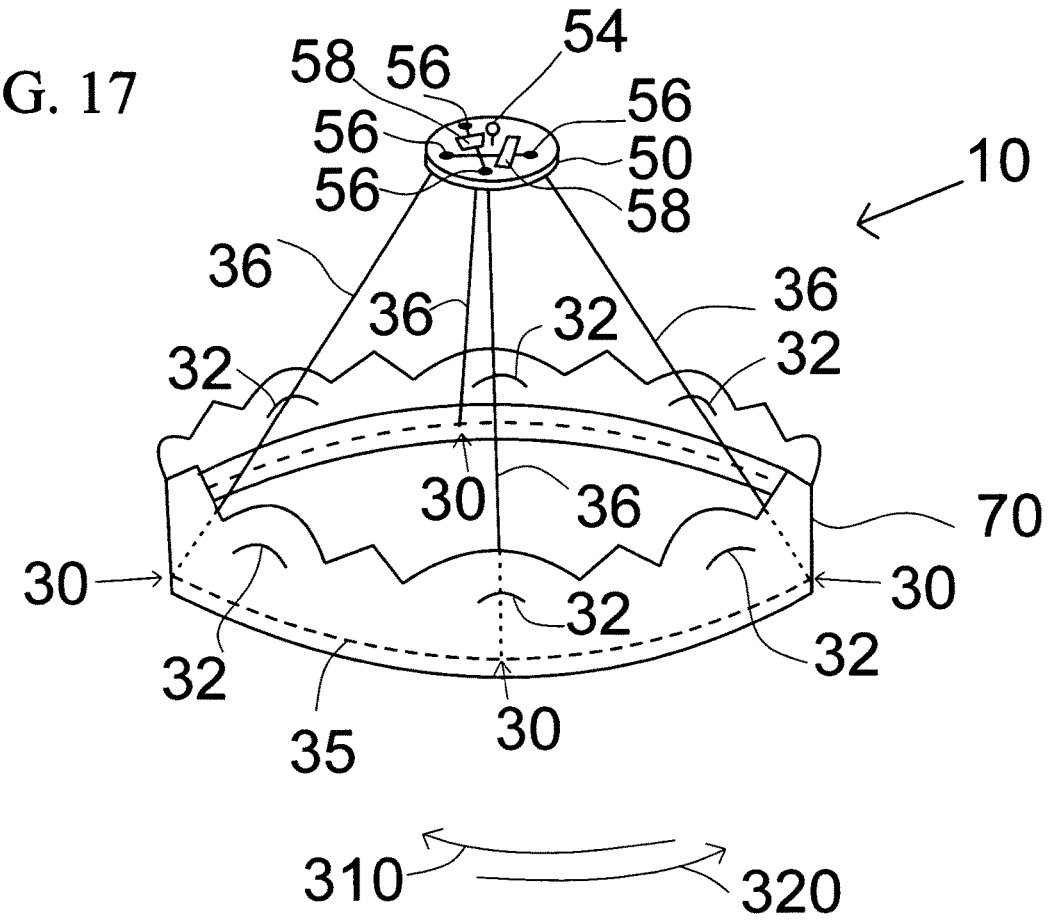
FIG. 17 is a frontal perspective view of an illustrative round mobile kit with two bridles in accordance with one embodiment.

FIG. 17 shows and exemplary embodiment of a round or oval display structure 70 showing no ornaments FIG. 15, 40, FIG. 16, 40, 41, 42, 43, 44, and no fan attachment device 110, 112, 114 or 115. The display structure 70 has incisions 32 for the future placement of one or more ornaments FIG. 15, 40, FIG. 16 40, 41, 42, 43, 44, (not shown). The display structure 70 has a rim 35 for structural strength. The display structure 70 is suspended from two bridles 36 for balance. The display structure 70 can revolve 310 or 320 from the air flow 300 of the ceiling fan 12 in either direction 310 or 320 when one or more three dimensional ornaments 41 or 42 or a combination thereof are added below the display structure 70 and facing in generally the same direction 310 or 320.

Figure 18:
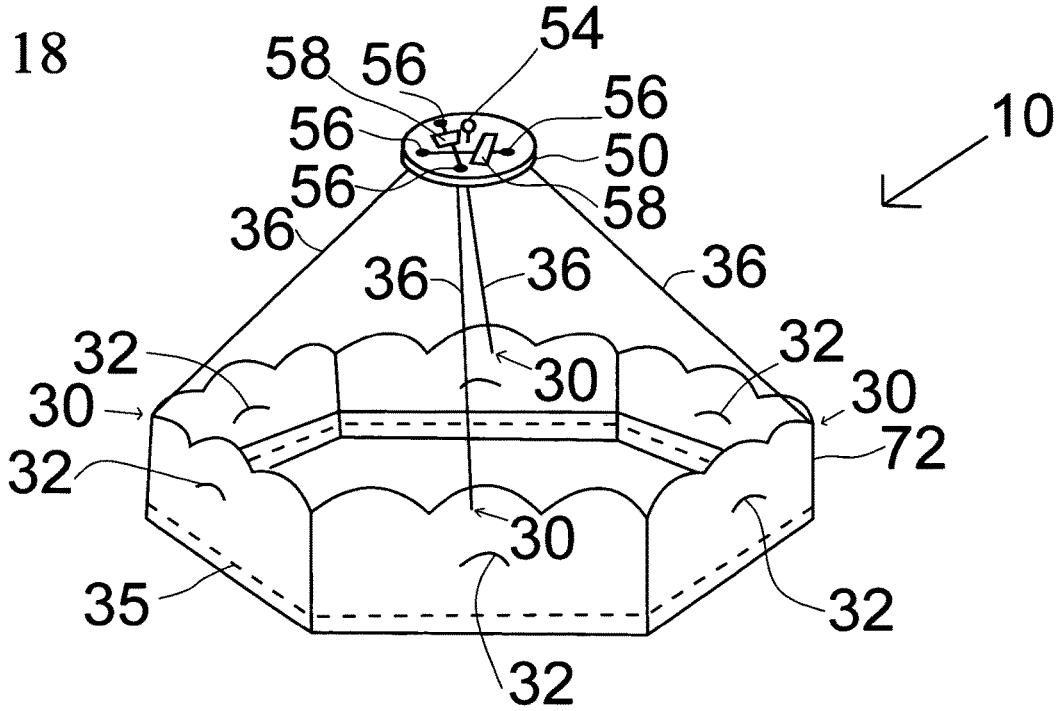
FIG. 18 is a frontal perspective view of an illustrative six sided mobile kit having two bridles in accordance with one embodiment.

FIG. 18 shows and exemplary embodiment of a geometrically shaped display structure 72 with no fan attachment device FIG. 7, 110, FIG. 8, 112, FIG. 9 114, FIG. 10, 115. The display structure 72 having six sides and two bridles 36 for balance and a rim 35 for structural strength. The display structure 72 has incisions 32 for the addition of one or more ornaments FIG. 15, 40, FIG. 16, 40, 41, 42, 43, 44 (not shown).

Figure 19A:
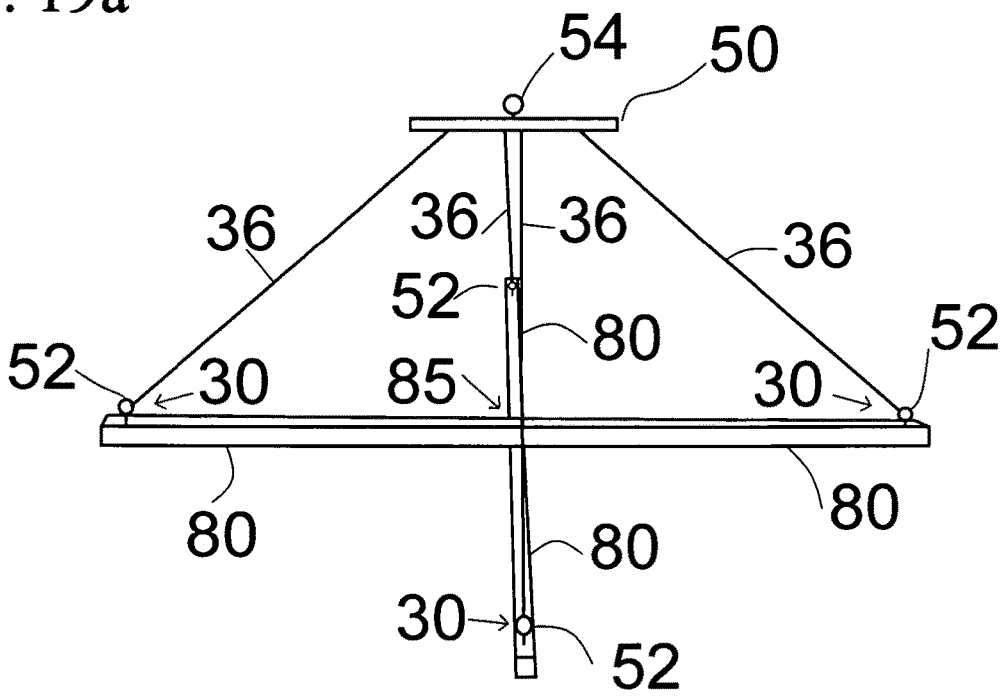
FIG. 19*a* is a frontal perspective view of an illustrative a two radial display structures mobile kit in accordance with one embodiment.

FIG. 19*a* shows and exemplary embodiment of a radial display structure 80 having two radial support structures 80 crisscrossing and overlapping each other and attached together at a generally central location 85. The radial display structure 80 having two bridles 36 for balance and the bridles 36 are co-operatively attached to the display structure 80 with screw eyes FIG. 11, 52. The bridles 36 thread through perforations (56 not shown) in the balancing platform 50. The balancing platform 50 having a screw eye FIG. 11, 54 or a swivel eye for co-operatively attaching to a fan attachment device FIG. 7, 110 FIG. 8, 112 FIG. 9, 114, FIG. 10, 115 (not shown).

Figure 19B:
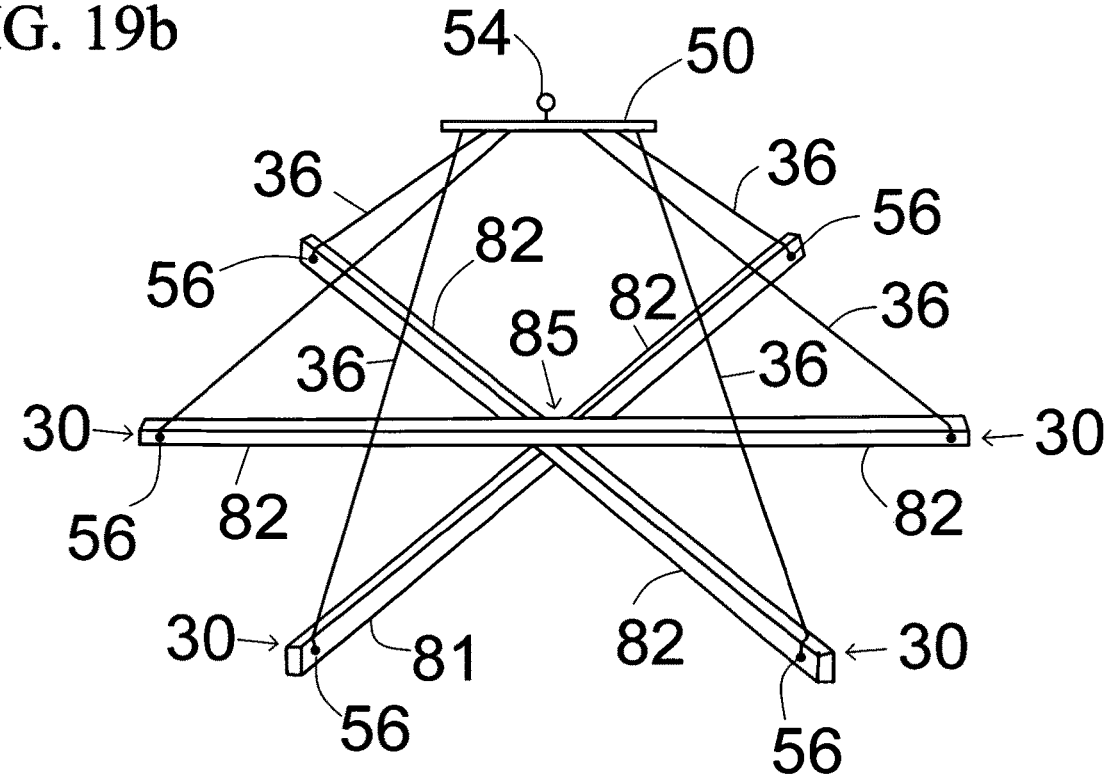
FIG. 19*b* is a frontal perspective view of an illustrative three radial display structure mobile kit in accordance with one embodiment.

FIG. 19*b* shows an exemplary embodiment of a radial display structure 82 having three radial support structures 82 crisscrossing and overlapping each other and attached together at a generally central location 85. The radial display structure 82 having three bridles 36 for balance, and the bridles 36 are tied to the radial display structure 81 through perforations 56. The bridles 36 also thread through perforations (56 not shown) in the balancing platform 50. The balancing platform 50 having a screw eye FIG. 11, 54 for co-operative attachment to a fan attachment device FIG. 110, FIG. 112, FIG. 114, FIG. 115 (not shown). The one or more ornaments 40, 41, 42, 43, 44, have not yet been co-operatively attached.

Figure 20:
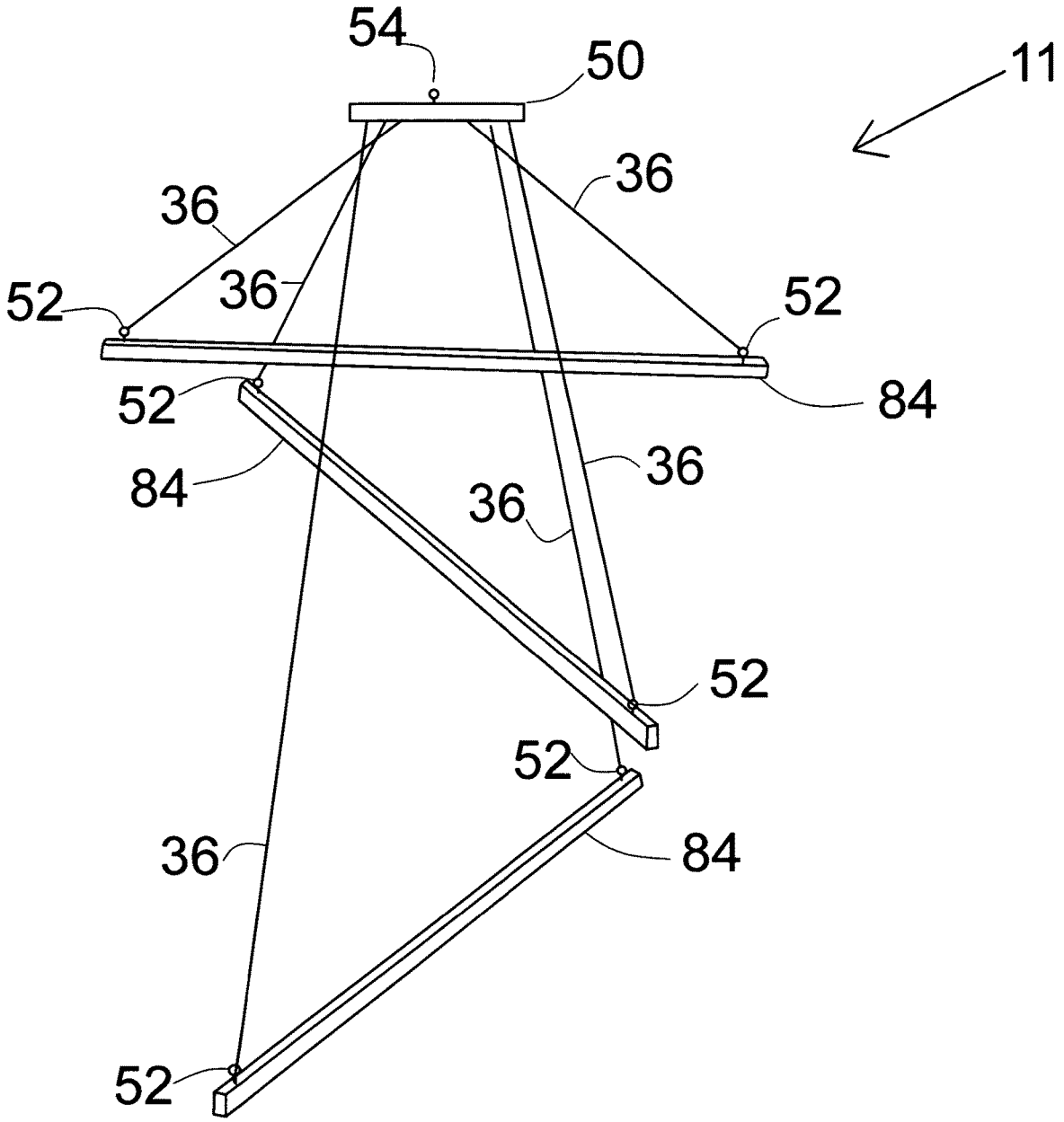
FIG. 20 is a frontal perspective view of an illustrative sequential mobile sharing one balancing platform in accordance with one embodiment.

FIG. 20 shows an exemplary embodiment of a radial display structure 84 having three radial display structures 84 suspended independently from one another. Each display structure 84 has a bridle 36 for balance and each bridle 36 of each display structure 84 threads through perforations (56 not shown) of the same balancing platform 50. The balancing platform 50 having a screw eye FIG. 54 or swivel eye for co-operative attachment to a fan attachment device FIG. 110, FIG. 112, FIG. 114, FIG. 115 (not shown). The one or more ornaments FIG. 15, 40, FIG. 16, 40, 41, 42, 43, 44, have not yet been co-operatively attached.

While the foregoing description includes details and specificities, it is to be understood that these have been included for purposes of explanation only, and are not to be interpreted as limitations of the invention. Modifications to the embodiment described above can be made without departing from the spirit and scope of the invention, which is intended to be encompassed by the following claims and their legal equivalent.

I claim:

1. A mobile with adjustable balance that suspends from a ceiling fan, the mobile revolving 360 degrees repeatedly in a consistent direction in airflow from the ceiling fan, the mobile comprising:

a fan attachment device, being an elongated support structure having an upper end and a lower end, the upper end of the fan attachment device co-operatively attaching to the ceiling fan, and the lower end of the fan attachment device co-operatively attaching to a balancing platform, the mobile including the balancing platform, the balancing platform being a supportive structure with an attachment element for co-operatively attaching to the lower end of the fan attachment device, the attachment element comprising the balancing point of the mobile, the balancing platform having two or more spaced-apart threading elements, one or more swivel elements, a swivel element of the one or more swivel elements being a supportive structure that revolves 360 degrees, the swivel element co-operatively attaching to the fan attachment device or to the balancing platform or a combination thereof, enabling the mobile to revolve 360 degrees repeatedly in the same direction in the airflow from the ceiling fan, one or more bridles, a bridle of the one or more bridles being a flexible elongated support structure supported by the balancing platform, a portion of the length of the bridle extending across an outer surface area of the balancing platform and threading through the two or more spaced-apart threading elements of the balancing platform, the bridle extending across opposite sides of the balancing point on the balancing platform, the bridle having two end portions extending downward from the balancing platform, one or more display structures, a display structure of the one or more display structures being a supportive structure suspended below the balancing platform by the bridle, the display structure having two or more bridle attachment points that are spaced-apart, the two end portions of the bridle co-operatively attaching to the display structure at two bridle attachment points of the two or more bridle attachments on the display structure, thus the two bridle attachment points that are spaced-apart give the display structure general stability in the airflow from the ceiling fan, the bridle being adjustable such that the relative lengths of the bridle that are on opposite sides of the balancing point and that extend downwards to the display structure determine the orientation of the display structure, one or more ornaments, an ornament of the one or more ornaments being a decorative structure co-operatively attaching to a structure of the mobile at one or more of a plurality of ornament attachment points on the mobile, the structure of the mobile being either the fan attachment device or the balancing platform or the swivel element or the bridle or the display structure or another ornament or a combination thereof, the bridle suspending the display structure and determining the orientation of the display structure, wherein the orientation of the display structure is capable of being easily changed in the event that the ornament of the one or more ornaments is added or removed or relocated or a combination thereof, and one or more securing elements, a securing element of the one or more securing elements co-operatively attaching the bridle to the balancing platform, thereby preventing slippage of the bridle and maintaining a generally stable orientation of the display structure relative to an axis of rotation of the mobile, wherein the airflow from the ceiling fan generates aerodynamic forces on the co-operatively attached mobile, enabling the mobile to revolve 360 degrees repeatedly in a consistent direction in the airflow, the relative lengths of the bridle on opposite sides of the balancing point and that extend downwards to the display structure determining the orientation of the display structure independent of the weight or placement or a combination of the weight and placement of the ornament of the one or more ornaments on the structure of the mobile, the orientation of the display structure being maintained by the securing element.

2. The mobile of claim 1 wherein the attachment element of the balancing platform is a screw eye that co-operatively attaches to the fan attachment device.

3. The mobile of claim 1 wherein the two or more threading elements of the balancing platform comprise two or more perforations, a perforation of the two or more perforations having two openings, a first opening being on an upper surface area of the balancing platform, the perforation extending downward through the interior of the balancing platform to a second opening on a lower surface area of the balancing platform, the interior sides of the perforation that extend between the first opening and the second opening being completely surrounded by the balancing platform, the bridle extending across the outer surface area of the balancing platform and the two end portions of the bridle threading downward through two perforations of the two or more perforations, the two end portions of the bridle extending downward from the two perforations.

4. The mobile of claim 1 wherein a sequencing mobile comprises the display structure of the mobile cooperatively attaching to an attachment element of a balancing platform of another mobile.

5. The mobile of claim 4 wherein an attachment device for sequencing is an elongated support element having an upper end and a lower end, the upper end co-operatively attaching to the display structure and the lower end cooperatively attached to the swivel element of the one or more swivel elements comprising a swivel that revolves 360 degrees with one or more attachment eyes and a cooperatively attached hooking device for co-operatively attaching to an attachment element of a suspended balancing platform of another mobile.

6. The mobile of claim 4 wherein an attachment device for sequencing is a flexible elongated material for co-operatively attaching the attachment element of the balancing platform to a display structure of another mobile.

7. The mobile of claim 4 wherein an attachment device for sequencing is a hooking device on the display structure that co-operatively attaches to an attachment element of a balancing platform of another mobile or co-operatively attaches to a fan attachment device of another mobile.

8. The mobile of claim 1 wherein the securing element is a type of releasable pressure sensitive adhesive element or a clamp or a structural element of the balancing platform that the bridle wraps around or a combination thereof.

9. The mobile of claim 1 wherein the balancing platform is three dimensional.

10. The mobile of claim 1 wherein the display structure is planar and the bridle of the balancing platform supports the orientation of the display structure.

11. The mobile of claim 1 wherein the bridle of the balancing platform supports the display structure in a generally horizontal orientation.

12. The mobile of claim 1 wherein the ornament is co-operatively attached to and suspended from a tethering line, the tethering line being a flexible elongated support filament that co-operatively attaches to the structure of the mobile, and the ornament randomly spins or randomly moves or a combination thereof in the airflow.

13. The mobile of claim 1 wherein the object is co-operatively attached to one or more ornament bridles, an ornament bridle being a flexible elongated support structure cooperatively attaching to the ornament at two or more ornament bridle attachment points for suspending and preventing the ornament from randomly spinning and thus maintaining the ornament in a generally stable orientation relative to the structure of the mobile to which the ornament bridle is co-operatively attached.

14. The mobile of claim 1 wherein the ornament is three dimensional.

15. The mobile of claim 1 wherein the ornament is co-operatively attached to two or more tethering lines, the two or more tethering lines being flexible elongated support structures for suspending and preventing the ornament from randomly spinning thus maintaining the ornament in a generally stable orientation relative to the structure of the mobile to which the tethering lines are co-operatively attached.

16. The mobile of claim 1 wherein the ornament is co-operatively attached to another ornament.

17. The mobile of claim 1 wherein an object is co-operatively attached to a tethering line, being a flexible elongated support filament, or attached to an ornament bridle, or both to stop slippage from the structure of the mobile to which the ornament is co-operatively attached.

18. The mobile of claim 1 wherein the structure of the mobile has one or more incisions to co-operatively attach the ornament.

19. The mobile of claim 1 wherein the ornament is co-operatively attached to one or more wires, the ornament being supported in mid-air by the one or more wires, the one or more wires having a predetermined length and prevent the ornament from randomly spinning thus the ornament maintains a generally stable orientation relative to the structure of the mobile to which the one or more wires is/are co-operatively attached.

20. The mobile of claim 19 wherein the one or more wires is/are three-dimensional.

21. The mobile of claim 19 wherein the one or more wires supporting the ornament in mid-air has/have a co-operatively attached clipping device for co-operatively attaching to the structure of the mobile.

22. The mobile of claim 19 wherein the one or more wires supporting the ornament in mid-air has/have a co-operatively attached clipping device for co-operatively attaching the one or more wires to the structure of the mobile.

23. The mobile of claim 19 wherein the one or more wires cooperatively attach to the display structure and support the ornament in mid-air above or below the display structure or a combination thereof.

24. The mobile of claim 1 wherein the fan attachment device consists of a swivel chain with a co-operatively attached clasp at the lower end for co-operatively attaching to the swivel element comprising a swivel that revolves 360 degrees with one or more attachment eyes and a cooperatively attached hooking device that co-operatively attaches to the attachment element of the balancing platform, and at the upper end of the swivel chain is a removable clasp for removably attaching to the swivel chain of the fan attachment device and a swivel pull chain of the ceiling fan.

25. The mobile of claim 1 wherein the fan attachment device consists of a swivel chain with a co-operatively attached clasp at the lower end to co-operatively attach the swivel element of the one or more swivel elements comprising a swivel that revolves 360 degrees with one or more attachment eyes and a cooperatively attached hooking device which co-operatively attaches to the attachment element of the balancing platform, and the upper end of the swivel chain having two interchangeable mechanisms for removably attaching to the ceiling fan, one mechanism being a removable attachment clasp that removably attaches to a swivel chain of the ceiling fan or the removable attachment clasp removably attaches to a lower end of a second swivel chain with a co-operatively attached clasp at the upper end which is co-operatively attached to a second swivel element of the one or more swivel elements comprising a swivel that revolves 360 degrees with one or more attachment eyes and a cooperatively attached hooking device for removably attaching to the ceiling fan with no swivel pull chain.

26. The mobile of claim 1 wherein an adhesive band, being adhesive on one side, cooperatively attaches to a portion of the ceiling fan below fan blades of the ceiling fan, the adhesive band cooperatively attaching to the upper end of the fan attachment device.

27. The mobile of claim 1 wherein the elongated support structure of the fan attachment device is made of flexible material.

28. The mobile of claim 1 wherein the attachment element of the balancing platform is a swivel eye that revolves 360 degrees and co-operatively attaches to the lower end of the fan attachment device.

29. The mobile of claim 1 wherein the display structure being top heavy has one or more balancing structures being in contact with the bridle so as to maintain the generally vertical orientation of the display structure.

30. The mobile of claim 1 wherein the display structure is three dimensional.

31. The mobile of claim 30 wherein the display structure is oval or round, or having three or more connected, generally vertical sides.

32. The mobile of claim 30 wherein the display structure is radial.

33. The mobile of claim 30 wherein the display structure is in the shape of a branch.

34. The mobile of claim 1, wherein the ornament does not randomly spin and thereby determines the direction of rotation of the display structure in the airflow.

35. The mobile of claim 1 wherein the display structure is rigid or flexible or a combination thereof.

36. The mobile of claim 1 wherein the ornament cooperatively attaches to the bridle.

37. The mobile of claim 1 wherein the ornament is planar.

38. The mobile of claim 1 wherein a tethering line being a flexible elongated support filament co-operatively attaches to the structure of the mobile and also cooperatively attaches to and suspends an ornament bridle, an ornament bridle being a flexible elongated support structure that cooperatively attaches at two or more ornament bridle attachment points on the ornament, and the ornament thus being suspended randomly spins or randomly moves or a combination thereof in the airflow.

39. The mobile of claim 1 wherein a tethering line being a flexible elongated support filament that co-operatively attaches and suspends two or more ornaments of the one or more ornaments, the tethering line having a single ornament of the two or more ornaments at each end portion of the tethering line, the tethering line co-operatively attaches to the structure of the mobile, and the two or more ornaments randomly spin, or randomly move or a combination thereof in the airflow.

40. The mobile of claim 1 wherein the mobile is decorative.

41. The mobile of claim 1 wherein the fan attachment device has co-operatively attached the swivel element of the one or more swivel elements, the swivel element comprising a swivel that revolves 360 degrees with one or more attachment eyes and a co-operatively attached hooking device.

42. The mobile of claim 1 wherein the bridle co-operatively attaches to the display structure by tying or gluing or a combination thereof.

43. The mobile of claim 1 wherein the elongated support structure of the fan attachment device cooperatively attaches at the lower end to the swivel element that comprises a swivel that revolves 360 degrees comprising a swivel with one or more attachment eyes with a co-operatively attached hooking device and at the upper end of the fan attachment device a co-operatively attached hooking device.

44. The mobile of claim 1 wherein the balancing platform supports two or more bridles of the one or more bridles, the two or more bridles cooperatively attaching to and suspending the display structure of the one or more display structures.

45. The mobile of claim 1 wherein the two end portions of the bridle diverge outward away from the balancing platform and co-operatively attaching to the display structure, thus the bridle attachment points on the display structure are further apart than the threading elements on the balancing platform.

46. The mobile of claim 1 wherein at least one ornament of the one or more ornaments maintains a generally stable orientation relative to the display structure.

* * * * *